US012644276B2

(12) United States Patent
Förg et al.

(10) Patent No.: US 12,644,276 B2
(45) Date of Patent: Jun. 2, 2026

(54) SEALING PROFILE FOR EDGE JOINTS, DRYWALL, AND METHOD FOR FASTENING

(71) Applicant: Hilti Aktiengesellschaft, Schaan (IL)

(72) Inventors: Christian Förg, Buchloe (DE); Manfred Klein, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 204 days.

(21) Appl. No.: 18/041,675

(22) PCT Filed: Aug. 20, 2021

(86) PCT No.: PCT/EP2021/073156
§ 371 (c)(1),
(2) Date: Feb. 14, 2023

(87) PCT Pub. No.: WO2022/043216
PCT Pub. Date: Mar. 3, 2022

(65) Prior Publication Data
US 2023/0304280 A1 Sep. 28, 2023

(30) Foreign Application Priority Data
Aug. 24, 2020 (EP) ..... 20192383

(51) Int. Cl.
*E04B 1/68* (2006.01)
*E04B 1/94* (2006.01)

(52) U.S. Cl.
CPC ..... *E04B 1/68* (2013.01); *E04B 1/948* (2013.01)

(58) Field of Classification Search
CPC ..... E04B 1/68; E04B 1/948
See application file for complete search history.

(56) References Cited

U.S. PATENT DOCUMENTS 1,559,749 A * 11/1925 Hall ..... E04B 1/4171 52/351
2,156,681 A * 5/1939 Dewhirst ..... E04B 1/6803 277/921

(Continued)

FOREIGN PATENT DOCUMENTS

| | | |
|---|---|---|
| DE | 202018100061 U1 | 2/2018 |
| EP | 0418699 | 3/1991 |
| FR | 1547020 | 11/1968 |

OTHER PUBLICATIONS

International Search Report dated Nov. 5, 2021, in PCT/EP2021/073156, with English translation, 5 pages.

(Continued)

*Primary Examiner* — Basil S Katcheves
(74) *Attorney, Agent, or Firm* — Grüneberg Global IP, PLLC

(57) ABSTRACT

A sealing profile can be used for sealing an edge joint between a cladding part of drywall and an adjacent floor, wall, or ceiling. The sealing profile contains a base body having an assembly side, which forms a support for the cladding part, and a fastening portion having a fastening side. The base body has fastening openings which are at a distance from one another in the direction of extent of the profile and which extend from the assembly side at least in portions up to the fastening portion. Furthermore, drywall can contain such a sealing profile, and a method can be used for fastening the sealing profile with fastening elements.

19 Claims, 3 Drawing Sheets

(56) References Cited

U.S. PATENT DOCUMENTS

| | | | | | |
|---|---|---|---|---|---|
| 2,178,388 | A * | 10/1939 | Beckman | A01D 61/00 | 52/514 |
| 3,903,587 | A * | 9/1975 | Boiardi | E04F 15/14 | 29/418 |
| 4,030,852 | A * | 6/1977 | Hein | E01C 11/126 | 404/66 |
| 4,058,947 | A * | 11/1977 | Earle | E04B 1/6801 | 404/66 |
| 4,346,542 | A * | 8/1982 | Tateno | E01C 11/106 | 52/396.02 |
| 4,366,284 | A * | 12/1982 | Ishido | E04B 1/6813 | 524/565 |
| 4,558,875 | A * | 12/1985 | Yamaji | E04B 1/6801 | 106/DIG. 4 |
| 4,733,513 | A * | 3/1988 | Schrader | E01C 11/14 | 404/59 |
| 4,884,381 | A * | 12/1989 | Betti | E04B 1/6801 | 52/396.06 |
| 4,964,256 | A * | 10/1990 | McCracken | B21D 47/01 | 29/897.34 |
| 5,249,401 | A * | 10/1993 | Schmid | E02D 29/16 | 52/576 |
| 5,327,693 | A | 7/1994 | Schmid | | |
| 5,339,590 | A * | 8/1994 | Kangas | E02B 3/16 | 52/396.02 |
| 5,377,469 | A * | 1/1995 | Schmid | E04B 1/68 | 52/576 |
| 5,609,006 | A * | 3/1997 | Boyer | E04B 2/7457 | 52/309.7 |
| 6,026,622 | A * | 2/2000 | Schmid | E04B 1/6816 | 52/250 |
| 8,640,415 | B2 | 2/2014 | Pilz et al. | | |
| 8,683,773 | B2 * | 4/2014 | Emmons | E04B 1/6812 | 52/742.16 |
| 8,793,947 | B2 | 8/2014 | Pilz et al. | | |
| 9,290,932 | B2 | 3/2016 | Pilz et al. | | |
| 9,683,364 | B2 | 6/2017 | Pilz et al. | | |
| 10,184,246 | B2 | 1/2019 | Pilz et al. | | |
| 10,494,818 | B2 * | 12/2019 | Maziarz | E06B 7/2303 | |
| 11,060,283 | B2 | 7/2021 | Pilz et al. | | |
| 11,905,705 | B2 | 2/2024 | Pilz et al. | | |
| 2005/0102941 | A1 * | 5/2005 | Barr | E04B 5/023 | 52/459 |
| 2010/0058696 | A1 * | 3/2010 | Mills | E01C 11/126 | 52/396.05 |
| 2011/0011019 | A1 * | 1/2011 | Stahl, Jr. | E04B 2/7411 | 52/309.1 |
| 2017/0260741 | A1 * | 9/2017 | Ackerman | A62C 2/065 | |
| 2017/0328057 | A1 * | 11/2017 | Pilz | E04B 2/7403 | |
| 2018/0002917 | A1 * | 1/2018 | Kleinhans | E04B 1/948 | |
| 2019/0284799 | A1 * | 9/2019 | Förg | E04B 1/948 | |
| 2019/0316348 | A1 * | 10/2019 | Pilz | E04C 3/29 | |
| 2020/0199867 | A1 * | 6/2020 | Ackerman | E04B 1/947 | |
| 2020/0291644 | A1 * | 9/2020 | Ober | E04B 1/6812 | |
| 2020/0340241 | A1 * | 10/2020 | Harder | E04B 1/947 | |
| 2021/0032927 | A1 * | 2/2021 | Brown | E04B 1/948 | |
| 2024/0263444 | A1 | 8/2024 | Pilz et al. | | |

OTHER PUBLICATIONS

Written Opinion dated Nov. 5, 2021, in PCT/EP2021/073156, with English translation, 10 pages.
Förg et al., U.S. Appl. No. 18/041,664, filed Feb. 14, 2023.
Förg et al., U.S. Appl. No. 18/042,467, filed Feb. 22, 2023.
Förg et al., U.S. Appl. No. 18/042,480, filed Feb. 22, 2023.
Förg et al., U.S. Appl. No. 18/042,498, filed Feb. 22, 2023.
Förg et al., U.S. Appl. No. 18/042,634, filed Feb. 23, 2023.
Förg et al., U.S. Appl. No. 18/042,767, filed Feb. 23, 2023.
U.S. Appl. No. 18/041,664, filed Feb. 14, 2023, Förg et al.
U.S. Appl. No. 18/042,498, filed Feb. 22, 2023, Förg et al.
U.S. Appl. No. 18/042,634, filed Feb. 23, 2023, Förg et al.
U.S. Appl. No. 18/042,767, filed Feb. 23, 2023, Förg et al.
U.S. Appl. No. 18/042,480, filed Feb. 22, 2023, Förg et al.
U.S. Appl. No. 18/042,467, filed Feb. 22, 2023, Förg et al.
Hilti, "Bottom Track Seal CFS-BTS", Product Information, CFS-BTS ⅝" and CFS-BTS 1-¼", Sep. 2023, 1 page.
Cemco®, "Hotrod® BW Compressible Firestop", Product Description, Feb. 11, 2025, 2 pages.
Cemco®, "Smoke & Sound Stop Blue (SSSB)", Product Description, Feb. 11, 2025, 2 pages.
"XHBN—Joint Systems: XHBN7—Joint Systems Certified for Canada", System No. BW-S-0024, UL Product IQ®, Sep. 6, 2024, 4 pages.
Blaze Foam, Intumescent compressible Firestop Foam, for Head of Wall Applications—Dynamic & Static, Blazing Fast Firestop Installation, RectorSeal, 2018, 2 pages.

* cited by examiner

SEALING PROFILE FOR EDGE JOINTS, DRYWALL, AND METHOD FOR FASTENING

CROSS-REFERENCE TO RELATED APPLICATIONS

This application is the National Stage entry under §371 of International Application No. PCT/EP2021/073156, filed on Aug. 20, 2021, and which claims the benefit of priority to European Application No. 20192383.6, filed on Aug. 24, 2020. The content of each of these applications is hereby incorporated by reference in its entirety.

BACKGROUND OF THE INVENTION

The invention relates to a sealing profile for sealing an edge joint between a cladding part of drywall and an adjacent floor, wall, or ceiling. The invention also relates to drywall having such a sealing profile, a stand construction, and a cladding part. The invention also relates to a method for fastening such a sealing profile to a carrier by means of fastening elements.

DESCRIPTION OF RELATED ART

Edge joints, in particular floor joints, are designed to provide sound decoupling of the drywall from adjacent walls, ceilings, or floors, in particular floorings.

The wall surfaces of the drywalls are formed by cladding parts such as gypsum boards, which often have to be protected from moisture. The edge joints therefore also form a barrier that protects the cladding parts against rising moisture, for example in the event of a pipe burst.

The edge joints are usually sprayed with a sealing compound in order to provide a sound and fire protection function and to seal the joint against air and odors.

Sealing compounds have the disadvantage that the application is time-consuming and not very ergonomic. Furthermore, sealing compounds can usually only be used reliably at temperatures of at least 5° C. and the substrate must be dry. The inspection is not easy either, since, for example, the installation depth cannot be checked non-destructively.

SUMMARY OF THE INVENTION

The object of the invention is to provide a sealing device for an edge joint of drywall, which ensures easy assembly of the sealing device and effective sealing of the edge joint.

To achieve the object, a sealing profile is provided as a sealing device for sealing an edge joint between a cladding part of drywall and an adjacent floor, wall, or ceiling. The sealing profile has a base body having an assembly side, which forms a support for the cladding part, and a fastening portion with a fastening side. The fastening portion and the fastening side are arranged opposite to the assembly side of the base body. Furthermore, the base body has fastening openings which are at a distance from one another in the direction of extent of the profile and which extend from the assembly side at least in portions up to the fastening portion.

It was recognized that the sealing profile can be fastened quickly and with little effort via the fastening openings by means of fastening elements such as nails or bolts. In the case of a sealing profile without fastening openings of this type, the assembly side is deformed in a crater shape in the direction of the fastening side, for example by means of the nail head, as a result of which the sealing properties of the sealing profile are impaired.

Furthermore, the sealing profile ensures that the edge joint has a defined width and is reliably sealed. The cladding part is thus effectively protected from moisture from an adjacent floor, wall, or ceiling by the sealing profile.

In this case, the fastening openings can extend completely through the base body. Due to the fact that the fastening openings are formed as through holes in the base body, the sealing profile can be fastened via the fastening openings by means of fastening elements such as nails or bolts without the base body being significantly deformed, since, for example, the nail head does not rest against or clamp the base body in the fastening direction.

DETAILED DESCRIPTION OF THE INVENTION

Figure 1:
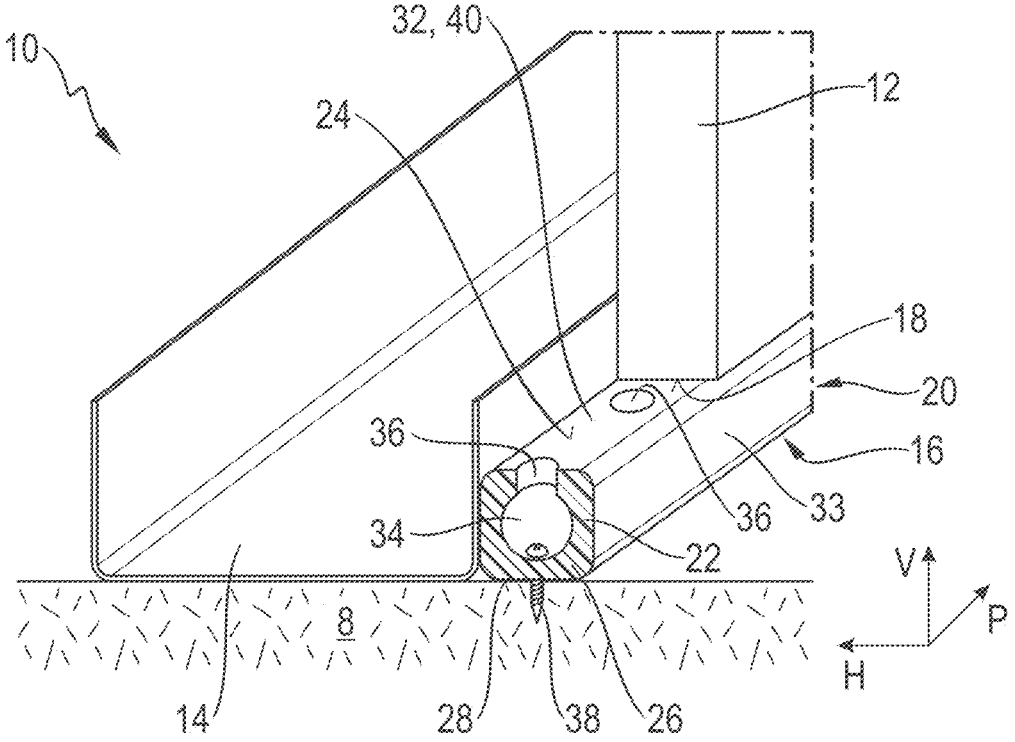
FIG. 1 is a perspective view of drywall according to the invention having a sealing profile according to the invention.

In one embodiment, the sealing profile has, at least in the portions of the fastening openings, a reinforcement which is arranged between the assembly side and the fastening side. In particular, the reinforcement is adjacent to the fastening portion or is arranged therein at least in portions. The reinforcement forms a robust and tear-resistant layer, which ensures that the sealing profile can be reliably fastened by means of fastening elements such as nails or bolts.

The reinforcement can be a reinforcement grid or reinforcement fabric or have reinforcement disks. In this way. the reinforcement can be defined and effectively arranged in the sealing profile, It can be provided that the base body and the fastening portions are formed together in one piece. As a result, the sealing profile can have constant sealing properties from the assembly side to the fastening side and, furthermore, can be produced with little effort.

In an alternative embodiment, the base body is formed from a first material and the fastening portion is formed from a second material which has a higher tensile strength than the first material. This has the advantage that the sealing profile can be reliably fastened by means of fastening elements, such as nails or bolts, which are driven through the fastening portion, Furthermore, a material can be used for the base body which has particularly good sealing properties, even if it only has a low tear resistance.

The second material is, for example, a viscoplastic material. In the scope of the invention, a viscoplastic material is understood to mean, in particular, a material that has an elasticity that corresponds to the elasticity of natural rubber, According to one embodiment, the fastening portion is formed from an intumescent material. Additionally or alternatively, the sealing profile can have a strip made of intumescent material which is arranged in particular between the base body and the fastening portion, As a result, the sealing profile has improved fire protection properties, The base body can be formed from a foam or an elastomer, as a result of which it has particularly good sealing properties.

According to a further embodiment, the sealing profile is a hollow profile with a cavity, in particular in the base body. The design as a hollow profile has the advantage that the sealing profile can be produced in a very material-efficient manner, Furthermore, the sealing profile can be more easily compressed in portions with a hollow profile, as a result of which rough cut edges of an adjacent cladding part are more effectively sealed in these portions.

Furthermore, the base body, in particular the sealing profile, can be an extrusion profile, as a result of which the sealing profile can be produced in any length with little effort.

It can be provided that the base body has at least two carrier portions, each of which can form a support for the cladding part. In particular, one of the carrier portions is arranged on the assembly side. Due to the multiple supports, the sealing profile can be used in different positions to seal the edge joint. This has the advantage that the sealing profile can be fastened to the adjacent carrier by means of fastening elements such as nails or bolts, which carrier is particularly suitable for this purpose due to its nature and/or shape. in this sense, a carrier is, for example, a stand construction of the drywall, a floor, a wall, or a ceiling.

According to the invention, drywall having a sealing profile according to the invention with the advantages mentioned above, a stand construction and a cladding part is also provided in order to achieve the above-mentioned object. The cladding part rests with its circumferential side against one side of the base body, while the sealing profile rests against an adjacent floor, wall, or ceiling. The sealing profile is fastened to the stand construction or the adjacent floor, wall, or ceiling by means of fastening elements. In this way, the edge joint that is formed between the cladding part and the adjacent floor, wall or ceiling, can be sealed reliably and with little effort by the sealing profile, In this case, in one embodiment, the fastening elements are nails and/or bolts, by means of which the sealing profile can be fastened in a short time and with particularly little effort, in particular with a nail gun or a bolt-firing device.

According to the invention, in order to achieve the aforementioned object, a method for fastening a sealing profile according to the invention with the aforementioned advantages is provided in which the sealing profile is fastened by means of fastening elements on a carrier, in particular on a stand construction, a floor, a wall, or a ceiling, comprising the following steps:

a) applying the sealing profile to the carrier so that the fastening side is facing the carrier, and
b) fastening the sealing profile to the carrier in that the fastening elements are driven or introduced into the carrier from the assembly side via the fastening openings through the fastening portion.

In this way, the sealing profile can be fastened quickly and with little effort in order to reliably seal an edge joint.

According to one embodiment, the fastening elements are nails and/or bolts, by means of which the sealing profile can be fastened in a short time and with particularly little effort, in particular with a nail gun or a bolt-firing device.

Figure 2:
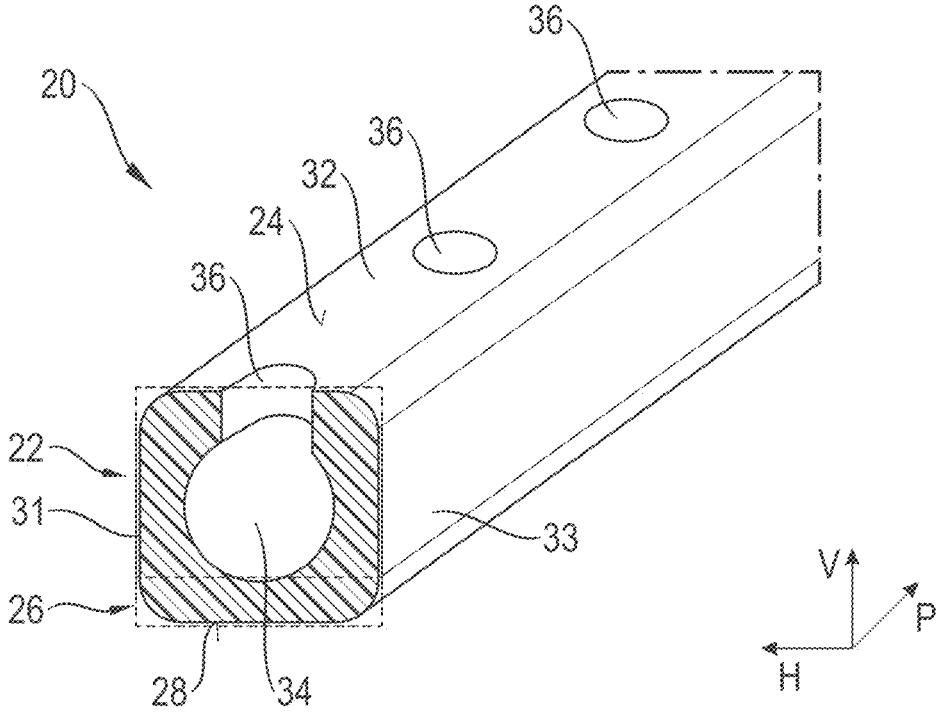
FIG. 2 is a perspective view of the sealing profile from FIG. 1.
Figure 3:
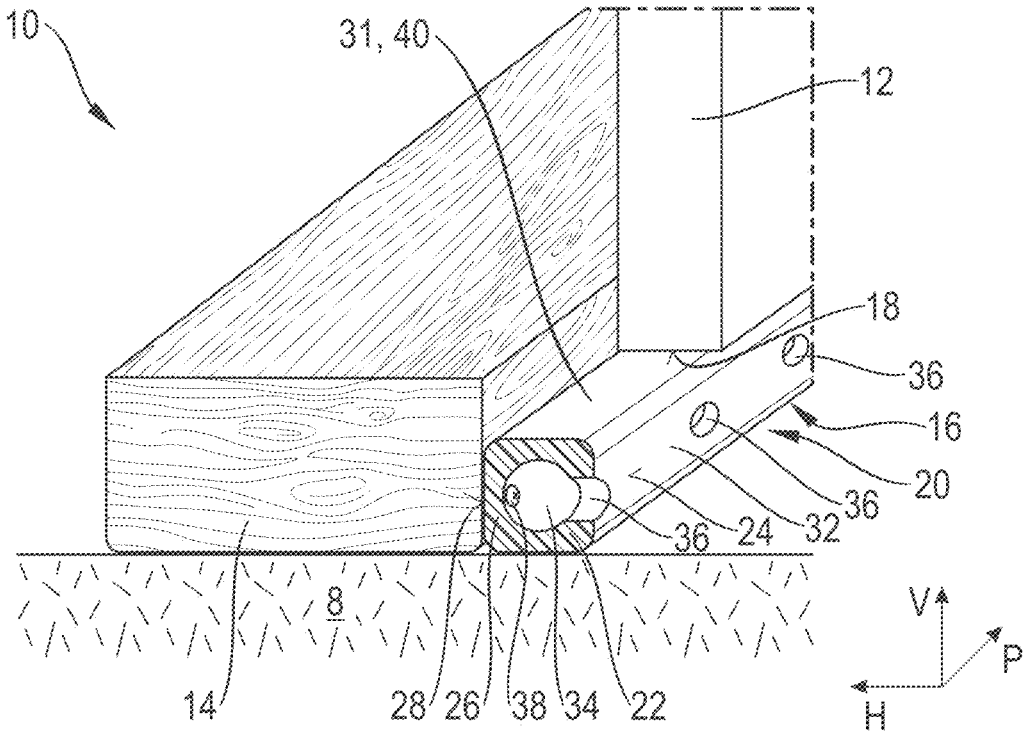
FIG. 3 is a perspective view of drywall according to the invention in accordance with a further embodiment having the sealing profile from FIG. 1.
Figure 4:
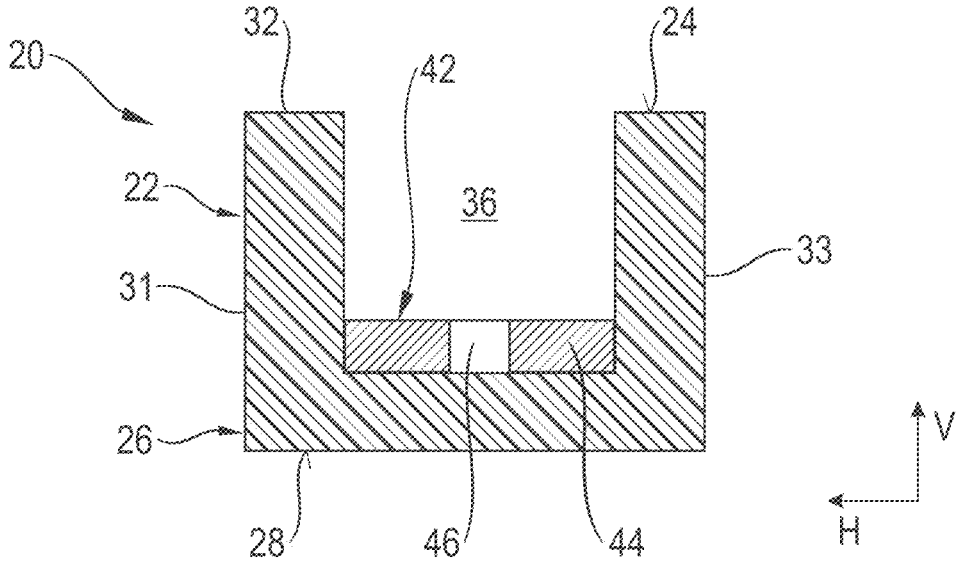
FIG. 4 is a schematic sectional view of a sealing profile according to the invention in accordance with a further embodiment.
Figure 5:
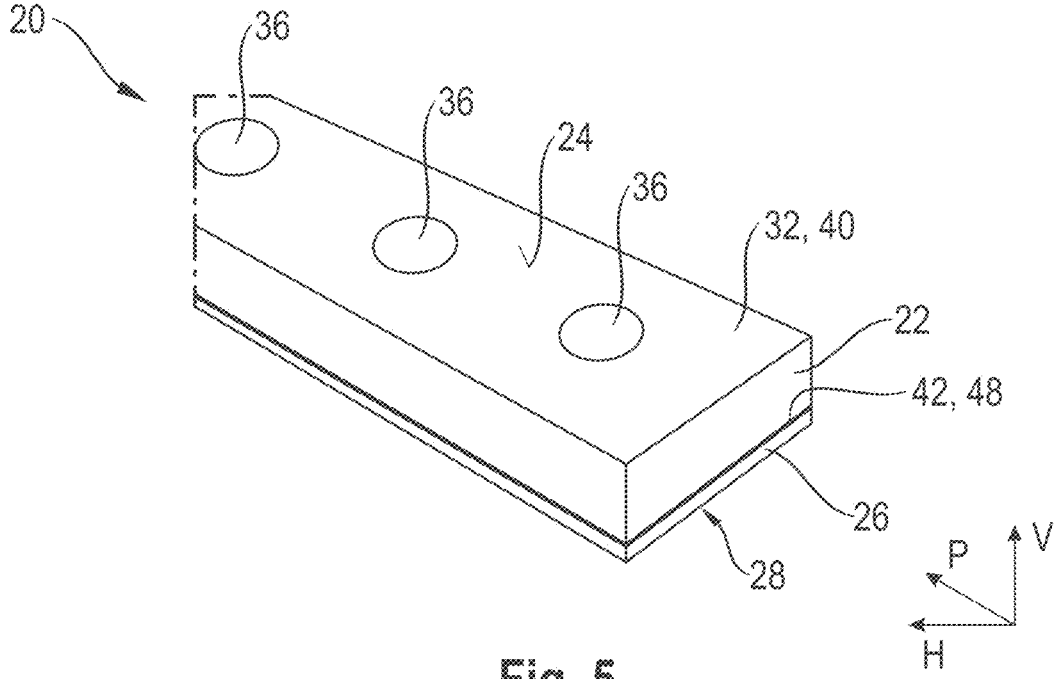
FIG. 5 is a perspective view of a sealing profile according to the invention in accordance with a further embodiment.
Figure 6:
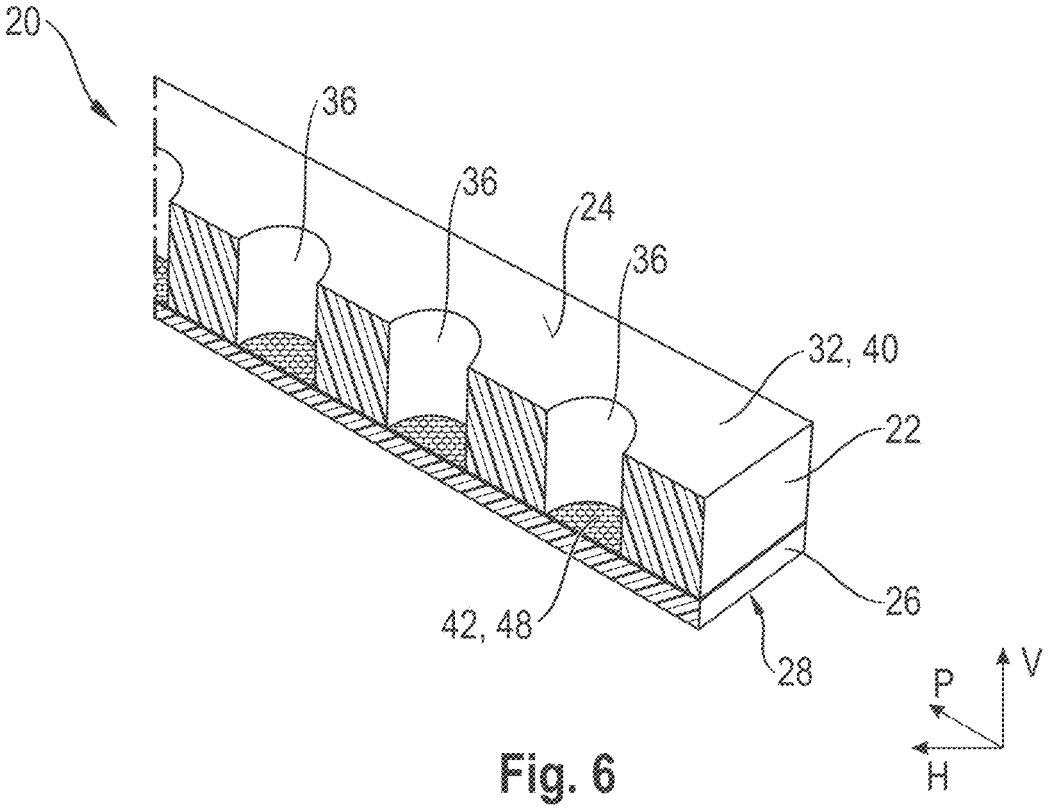
FIG. 6 is a schematic sectional view of the sealing profile from FIG. 5.

Further advantages and features emerge from the following description and from the accompanying drawings. In the drawings:

FIG. 1 is a perspective view of drywall according to the invention having a sealing profile according to the invention, FIG. 2 is a perspective view of the sealing profile from FIG. 1, FIG. 3 is a perspective view of drywall according to the invention in accordance with a further embodiment having the sealing profile from FIG. 1, FIG. 4 is a schematic sectional view of a sealing profile according to the invention in accordance with a further embodiment, FIG. 5 is a perspective view of a sealing profile according to the invention in accordance with a further embodiment, and FIG. 6 is a schematic sectional view of the sealing profile from FIG. 5.

FIG. 1 is a cross section of drywall 10 with a cladding part 12 (gypsum wall) and a holding rail 14, which is part of a stand construction of the drywall 10.

In the present case, the holding rail 14 is a floor profile that is firmly anchored on the floor 8 extending in the horizontal direction H, for example by means of dowels.

The cladding part 12 is attached to the stand construction at a distance from the floor 8, as a result of which an edge joint 16 in the form of a floor joint in the vertical direction V is formed between a circumferential side 18 of the cladding part 12 and the floor 8.

In order to seal the edge joint 16, the drywall 10 also has a hollow sealing profile 20, the structure of which is described below with reference to FIG. 2. The sealing profile 20 is also suitable for sealing the edge joint 16 between drywall 10 and the ceiling and/or wall.

The sealing profile 20 has a base body 22 having an assembly side 24 and a fastening portion 26 having a fastening side 28. The assembly side 24 and fastening side 28 form in this case mutually opposite sides of the sealing profile 20, which are aligned in parallel.

The sealing profile 20 has a cross section with a square basic shape.

The base body 22 has three planar carrier portions 31, 32, 33. A carrier portion 32 is adjacent to the assembly side 24, while the other two carrier portions 31, 33 are each adjacent to a side of the sealing profile 20 which connects the assembly side 24 to the fastening side 28.

The sealing profile 20 is a hollow profile having a cavity 34 which is adjacent to the fastening portion 26 and extends through the base body 22 in the direction of extent P of the profile.

In the present embodiment, the sealing profile 20 is an extruded profile.

The base body 22 is formed in one piece together with the fastening portion 26 and thus consists of the same material as said fastening portion.

The sealing profile 20 consists of a plastics material, for example EPDM, PE foam, PP foam, PS foam, particle foam, silicone foam, a thermoplastic elastomer.

In principle, the sealing profile 20 can be made of any material and in any way. However, at least the base body 22 is preferably an extruded profile.

For fastening the sealing profile 20, the sealing profile 20 has fastening openings 36 in this case which are arranged at regular intervals in the direction of extent P of the profile and extend perpendicularly from the assembly side 24 through the base body 22 into the cavity 34.

In order to reliably seal the edge joint 16 with the sealing profile 20, during the assembly of the drywall 10, the sealing profile 20 is fastened adjacent to the holding rail 14 (see FIG. 1) on the floor 8 by means of fastening elements 38 in the form of nails or bolts.

In this case, in a first step, the sealing profile 20 is placed with the fastening side 28 on the floor 8.

In a second step, the fastening elements 38 are driven into the floor 8 via the fastening openings 36 through the fastening portion 26.

In this way, the sealing profile 20 is fastened to the floor 8 by means of the fastening elements 38 via the fastening portion 26.

The cladding part 12 is now set up with its circumferential side 18 on the carrier portion 32, so that the sealing profile 20 is pressed against the floor 8, and it is then fastened to the stand construction of the drywall 10.

The carrier portion 32 forms a support 40 against which the cladding part 12 rests with its circumferential side 18.

By placing the cladding part 12 on the carrier portion 32 during assembly, it is ensured that the edge joint 16 has a defined width, while the weight of the cladding part 12 ensures that the sealing profile 20 rests sealingly against the floor 8.

In principle, the sealing profile 20 can be used to seal any edge joint 16 that is formed between a circumferential side 18 of the cladding part 12 and an adjacent floor, wall, or ceiling.

Of course, additionally or alternatively to nails and/or bolts, any desired fastening elements 38, for example clips, can be used for fastening.

Drywall according to a further embodiment will now be described with reference to FIG. 3. The same reference signs are used for the components which are known from the above embodiment and in this respect reference is made to the preceding explanations.

In contrast to the drywall 10, which is shown in FIG. 1, the sealing profile 20 is fastened to the holding rail 14, which consists of a wooden strip and thus forms a suitable carrier for fastening the sealing profile 20.

In this case, the fastening side 28 of the sealing profile 20 rests against the holding rail 14, while the cladding part 12 rests with its circumferential side 18 against the carrier portion 31.

In this embodiment, the assembly side 24 is exposed, whereby the fastening openings 36 are accessible even after the cladding part 12 has been set up on the sealing profile 20. The sealing profile 20 can thus be fastened to the holding rail 14 before and/or after the cladding part 12 has been placed on the support 40.

A sealing profile according to a further embodiment will now be described with reference to FIG. 4. The same reference signs are used for the components which are known from the above embodiments and in this respect reference is made to the preceding explanations.

FIG. 4 shows a cross section of the sealing profile 20 at a point with a fastening opening 36.

The fastening opening 36 extends from the assembly side 24 up to the fastening portion 26 completely through the base body 22.

The sealing profile 20 has a reinforcement 42 in the form of reinforcement disks 44, which are arranged in the fastening openings 36 adjacent to the fastening portion 26.

The reinforcement disks 44 are made of plastics material or metal, for example.

Additionally or alternatively, the reinforcement disks 44 can be received in a clamped manner in the fastening openings 36 or integrally bonded to the base body 22 and/or the fastening portion 26.

The reinforcement 42 serves to make the portion at which the sealing profile 20 is connected to the fastening element 38 more robust.

The reinforcement disks 44 each have a passage 46 which ensures that the fastening elements 38 can penetrate the reinforcement 40 in a defined manner at this point. As an alternative to this, no passage 46 in the reinforcement disks 46 is present, so that the bolt or nail is driven through the reinforcement disk 44 and then through the sealing profile 20.

The sealing profile 20 is designed in this case as a solid profile, i.e. without a cavity 34, but this can also be different.

A sealing profile 20 according to a further embodiment will now be described with reference to FIGS. 5 and 6. The same reference signs are used for the components which are known from the above embodiments and in this respect reference is made to the preceding explanations.

In this embodiment, the sealing profile 20 is designed in three layers. The base body 22 and the fastening portion 26 each form a layer, which layers are connected via an intermediate layer in the form of the reinforcement 42.

The reinforcement 42 is in this case a reinforcement grid 48 which extends adjacent to the fastening portion 26 and parallel to the fastening side 28 in the direction of extent P of the profile.

In an alternative embodiment, the reinforcement 42 can be arranged at any point in or adjacent to the base body 22 and/or fastening portion 26 and extend in any way through or relative to the base body 22 and/or the fastening portion 26.

However, the reinforcement 42 preferably extends over the region in which the fastening openings 36 are arranged and in or adjacent to the fastening portion 26.

The reinforcement 42 is, for example, a polyester or glass fiber mesh.

In principle, the reinforcement 42 can have any structure. In particular, in an alternative embodiment, the reinforcement 42 can be a reinforcement fabric.

The fastening openings 36 are through holes that extend completely through the base body 22.

In all embodiments, the fastening openings 36 can have any depth, i.e. the fastening openings 36 can extend from the assembly side 24 over any distance counter to the vertical direction V into the base body 22.

Furthermore, the fastening openings 36 can in principle be arranged at any points in the base body 22.

In an alternative embodiment, the fastening openings 36 are adjacent to a side surface of the base body 22, which is interrupted in this way by the fastening openings 36. An embodiment of this type corresponds, for example, to the embodiment shown in FIG. 6, but in this case FIG. 6 does not show a sectional view of the sealing profile 20, but rather the sealing profile 20 itself or a portion thereof in a perspective view. The advantage of this embodiment is that the fastening openings 36 can have a large diameter or cross section, as a result of which the sealing profile 20 can be fastened easily via the fastening openings 36. At the same time, due to the lateral arrangement of the fastening openings 36, the base body 22 is sufficiently massive to seal an edge joint 16 reliably.

In the embodiment shown in FIGS. 5 and 6, the main body 22 is formed from a material with high elasticity, for example foam, whereby the base body forms a sealing element with a particularly high sealing effect.

The fastening portion 26, on the other hand, is formed from a viscoplastic material, for example rubber, which has a higher tensile strength compared to the base body 22.

In order to provide a sealing profile 20 with particularly good fire protection properties, the fastening portion 26 can be formed from an intumescent material.

Additionally or alternatively, the sealing profile 20 can have a strip made of intumescent material which, for example, forms a further layer between the base body 22 and the fastening portion 26.

In embodiments in which the base body 22 and/or the fastening portion 26 are formed from a temperature-resistant material, a fire protection design of the sealing profile 20 can be designed without intumescent material.

In contrast to the sealing profile 20 shown in FIG. 1, the sealing profile 20 in FIGS. 5 and 6 has a rectangular cross section. Furthermore, only the assembly side 24 is provided as a carrier portion 32, which forms a support 40.

Of course, any desired sides of the base body 22 can be provided as carrier portions 31, 32, 33 in an alternative embodiment.

To produce the sealing profile 20, the base body 22, the fastening portion 26, and the reinforcement 42 can be bonded or welded to one another, for example by means of ultrasonic welding.

In an alternative embodiment, the sealing profile 20 can be produced by means of 2-component extrusion.

In order to seal particularly deep edge joints 16, a plurality of sealing profiles 20 can be arranged adjacent in series in the horizontal direction H in all embodiments. For example, in the case of drywall 10 having a wall with double-layer cladding consisting of two adjacent cladding parts 12, two sealing profiles 20 can be arranged in the edge joint 16, each sealing profile 20 forming a support 40 for a cladding part 12.

In this way, a sealing profile 20 is provided for an edge joint 16 of drywall 10, which in all embodiments ensures easy assembly of the sealing profile 20 combined with the setting up of the stand construction.

In particular, the design of the sealing profile 20 ensures that it can be fastened quickly and reliably by means of fastening elements such as nails or bolts.

Furthermore, the sealing profile 20 ensures that the edge joint 16 is effectively sealed with respect to air and sound.

The sealing profile 20 turns the drywall 10 into a fire-safe construction, by means of which smoke, temperature, and fire can be prevented from spreading over to the side of the drywall 10 that faces away from the fire.

The dimensions of the sealing profile 20 ensure a defined joint width and also protect the cladding part 12 against moisture in or on the floor 8, in particular during the construction phase.

Furthermore, the sealing profile 20 is a factory-made application solution with constant properties, which makes the sealing of edge joints with a consistently high quality easier.

The invention is not limited to the embodiments shown. In particular, individual features of one embodiment can be combined in any way with features of other embodiments, in particular independently of the other features of the corresponding embodiments.

The invention claimed is:

1. A sealing profile for sealing an edge joint between a cladding part of drywall and an adjacent floor, wall, or ceiling, the sealing profile comprising:

a base body having an assembly side, wherein the base body forms a support for the cladding part, and a fastening portion having a fastening side, wherein the fastening portion and the fastening side are arranged opposite to the assembly side of the base body, wherein the base body has fastening openings which are at a distance from one another in a direction of extent of the sealing profile and which extend from the assembly side at least in portions up to the fastening portion;

the base body is formed from a foam or an elastomer, and said fastening openings do not extend through said fastening portion and allow access to said fastening portion to secure said sealing profile through said fastening portion, wherein the sealing profile has a reinforcement at least in portions of the fastening openings, wherein the reinforcement is arranged between the assembly side and the fastening side, and wherein the reinforcement is a reinforcement grid or a reinforcement fabric or is in a form of reinforcement disks.

2. The sealing profile according to claim 1, wherein the reinforcement is said a reinforcement grid or said a reinforcement fabric.

3. The sealing profile according to claim 1, wherein the base body and the fastening portion are formed together in one piece.

4. The sealing profile according to claim 1, wherein the base body is formed from a first material of a foam or an elastomer, and the fastening portion is formed from a second material, the second material having a higher tensile strength than the first material.

5. The sealing profile according to claim 4, wherein the second material is a viscoplastic material.

6. The sealing profile according to claim 1, wherein the fastening portion is formed from an intumescent material, and/or the sealing profile has a strip made of intumescent material.

7. The sealing profile according to claim 6, wherein the strip made of intumescent material is arranged between the base body and the fastening portion.

8. The sealing profile according to claim 1, wherein the sealing profile is a hollow profile with a cavity.

9. The sealing profile according to claim 8, wherein the cavity is in the base body.

10. The sealing profile according to claim 1, wherein the base body is an extrusion profile.

11. The sealing profile according to claim 1, wherein the base body has at least two carrier portions which can each form a support for the cladding part.

12. The sealing profile according to claim 11, wherein one of the at least two carrier portions is arranged on the assembly side.

13. A drywall, comprising:

the sealing profile according to claim 1, a stand construction, and the cladding part, wherein a circumferential side of the cladding part rests against one side of the base body, and the sealing profile rests against an adjacent floor, wall, or ceiling, wherein the sealing profile is fastened to the stand construction or the adjacent floor, wall, or ceiling with fastening elements.

14. The drywall according to claim 13, wherein the fastening elements are nails and/or bolts.

15. A method for fastening the sealing profile according to claim 1 with fastening elements on a carrier, the method comprising:

a)applying the sealing profile to the carrier so that the fastening side is facing the carrier, and b) fastening the sealing profile to the carrier, wherein the fastening elements are driven into the carrier from the assembly side via the fastening openings through the fastening portion.

16. The method according to claim 15, wherein the fastening elements are nails and/or bolts.

17. The sealing profile according to claim 1, wherein the reinforcement is adjacent to the fastening portion.

18. The sealing profile according to claim 1, wherein the base body consists of a foam selected from the group consisting of PE foam, PP foam, PS foam, particle foam, and silicone foam.

19. The sealing profile according to claim 1, wherein the base body consists of an elastomer selected from the group consisting of EPDM and a thermoplastic elastomer.

* * * * *